United States Patent [19]

Nava

[11] 4,449,275

[45] May 22, 1984

[54] DEVICE TO SECURE BELTS AND SIMILAR PARTS TO RESIN STRUCTURES, HELMETS IN PARTICULAR

[76] Inventor: Pier L. Nava, Via Carnovali 100/C, Bergamo, Italy

[21] Appl. No.: 415,966

[22] Filed: Sep. 8, 1982

[30] Foreign Application Priority Data

Oct. 1, 1981 [IT] Italy ..... 24257 A/81

[51] Int. Cl.[3] ..... A44B 17/00

[52] U.S. Cl. ..... 24/458; 24/462; 24/265 EC

[58] Field of Search ..... 24/265 A, 265 EC, 214, 24/213 R, 213 B, 129 B, 129 D, 297, 295

[56] References Cited

U.S. PATENT DOCUMENTS 3,106,759 10/1963 Kytta ..... 24/213 R

*Primary Examiner*—R. Peshock

*Attorney, Agent, or Firm*—Ladas & Parry

[57] ABSTRACT

The device to secure belts and similar parts to resin structures is provided with (Ref. FIG. 4) a block B in elastically yieldable molded material is inserted by snap action in a seat 24 in helmet A engaging forcibly by means grooves and projecting parts 22 in the block itself. One of the ends of the latter is fitted with a flange 12 which engages a recess 26 in the wall of the helmet.

Belt C is conveniently and directly secured to block B by folding. The end of said belt, and which is associated with a pin 20. The whole is then inserted into an aperture-slot 18–16 provided in block B and this latter is then introduced in aperture 24.

12 Claims, 6 Drawing Figures

DEVICE TO SECURE BELTS AND SIMILAR PARTS TO RESIN STRUCTURES, HELMETS IN PARTICULAR

DESCRIPTION OF THE INVENTION

This invention relates to a device apt to secure belts and similar parts to resin structures, helmets, in particular.

Anchoring of the belts to the helmets is effected, generally, by screws or rivets passing through the rigid shell of the helmet and which connect by contrast one wall of said shell, for example the external wall, directly with the belt or metal plates to which the belt itself is secured, and abut with the opposite wall.

As helmet molded shells are usually made of rigid resins, any tensions applied to the belt are transmitted directly to said material and may crack it and/or rip off the securing means; in the case of an internal metal plate secured by screws on a molded helmet, for example, of polycarbonate material, excessively tight screwing may damage the helmet, by compression, even during its assembling phase.

The object of this invention is to obviate the above drawbacks by providing a device which, by distributing stresses over a larger area and by the adoption of a more elastic material with respect to that of the helmet, makes possible a reliable anchorage, apt to withstand stresses or tear of high intensity.

The device according to the invention consists of a molded block, made at least in part of material of suitable resilient with respect to the material of the helmet and which is inserted in a cavity in the helmet itself to retain directly one end of a belt, or indirectly plates or buckles to which the belt is in turn anchored.

The above device also affords the advantage of being adoptable to a single type of housing in the helmet, yet being apt to retain the belt or similar either directly or indirectly by means of adjustable securing means.

This fact makes the mass production of helmets which are suitable to be fitted with the most convenient elements.

The device in one of its preferred forms is characterized in that the block is equipped at one of its ends with a peripheral flange fitting in a groove in one of the walls of the helmet, while the longitudinal walls of said block are provided with grooves (or projecting parts) which engage foribly and elastically in respective seats in the opposite walls of the aperture in the helmet.

In the domain of this invention, the engagement of said grooves or projecting parts in the block with the projecting parts (or grooves in the walls of the aperture in the helmet) may be either partial or complete.

Advantageously, the block is provided with a slotted seat to retain the folded end of the belt, associated with a pin, the length of which can be at least equal to or greater than the width of the belt; in this latter case, the ends of the pin fit in relative recesses in the mid parts of the opposite walls of the cavity in the helmet.

According to one variant the block is provided with at least one through hole, substantially perpendicular to the grooves and/or projecting parts, to retain a plate carrying the adjustable securing devices for the belt, while a screw secures said plate to the block, which in turn, is engaged elastically to the walls of the aperture in the helmet.

In this variant, the head of the lock screw fits in a groove in the flange of the block, so that the head of said screw and the flange itself do not project from the outer surface of the helmet.

The invention will now be explained in the following description, in conjunction with the annexed drawings, which illustrate, by way of example, different forms of embodiment of the device according to the invention. In the drawings.

Figure 1:
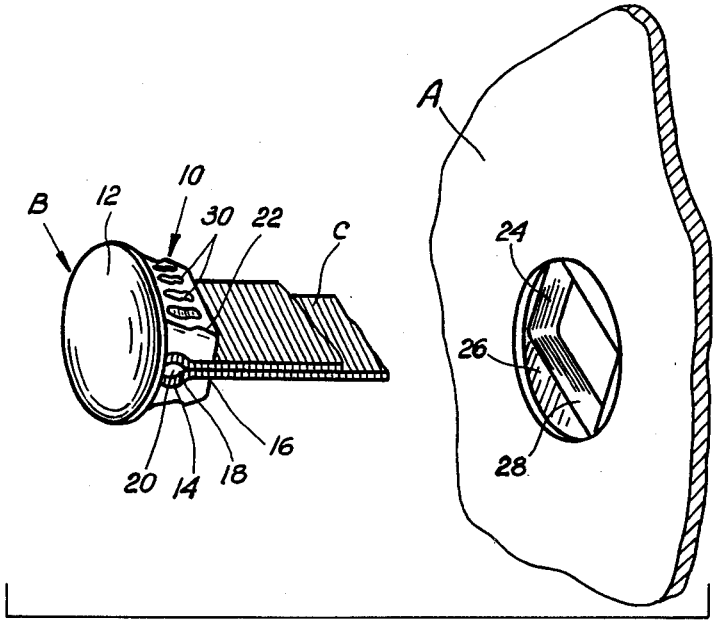
FIG. 1 is an exploded sectional view of the device according to the invention, detached from the supporting structure.

Considering the device shown in the drawings, letter A identifies the resin structure, which in our specific case consists of a protective helmet retaining by means of device B a belt C or similar part, apt to secure the helmet to the wearer's head.

Figure 2:
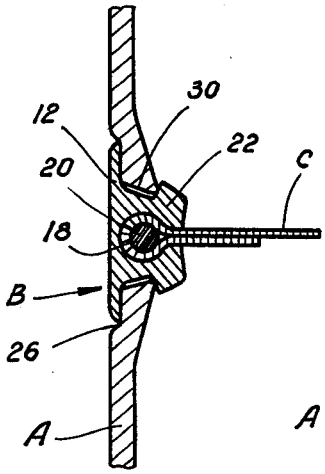
FIG. 2 is a transversal section on lines X of FIG. 1.

With reference to the device shown in FIGS. 1 and 2, the device is provided with a block 10, made of resilient material, the top part of which terminates with a head 12 forming a flange for the purposes that will be described infra.

In the case illustrated, the form of block 10 is substantially parallelopipedal and has, along its longitudinal axis, a substantially circular housing 14 associated with a slot 16 to connect said housing to the lower end of the block.

In this manner a seat is formed, to retain belt C, specifically the folded end 18 of said belt which is thus secured to said block 10 by a pin 20.

The opposite longitudinal walls of block 10 are shaped so as to form at their lower edges enlargements 22 for blocking purposes, and which will be described infra.

Supporting structure A, that is, one of the lateral parts of the helmet in the case considered, is provided with a quadrilateral aperture 24 corresponding to the contour of block 10 and which terminates, at the external surface of the helmet, with a circular groove 26 housing flange 12 of the top part of said block.

The opposite longitudinal walls 28 of quadrilateral opening 24 are shaped so as to have an inclination converging in the downward direction, so that the lower edges of said walls will form teeth apt to engage resilient the opposite grooves of the longitudinal walls of block 10, above enlarged parts 22.

It is evident that the securing of belt C to helmet A: i.e. firstly the user forms loop 18 at the end of belt C and introduces in said loop pin 20, the length of which, in this case, is substantially equal to the width of belt C. These parts are then inserted in housing 14–16 of block 10 so that the tract formed by the double belt projects outwardly from the block through slot 16.

After this, block 10, on which the belt is fitted, is introduced forcibly into opening 24 so that flange 12 will fit in circular groove 26, at the same level as the outer surface of helmet A when block 10 is engaged in opening 24, the longitudinal opposite edges of the walls of said opening 24, resiliently engage with the slots above enlargements 22 thereby ensuring retention of the tail of the belt within slot 16: the end of belt C is thus firmly secured to the structure of the helmet.

In order to facilitate the engagement as well as disengagement of block 10 of aperture 24, the longitudinal side walls of said block are provided with transversal 30, to increase the resilienty of the block.

Figure 3:
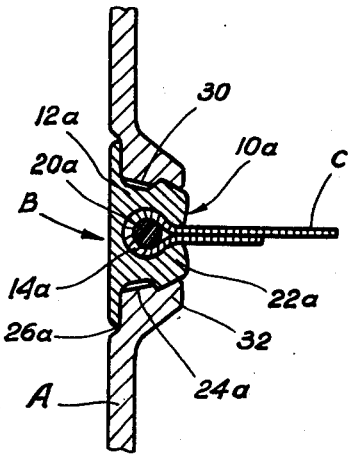
FIG. 3 is a sectional view, similar to FIG. 2, of a variant of embodiment of the device.
Figure 4:
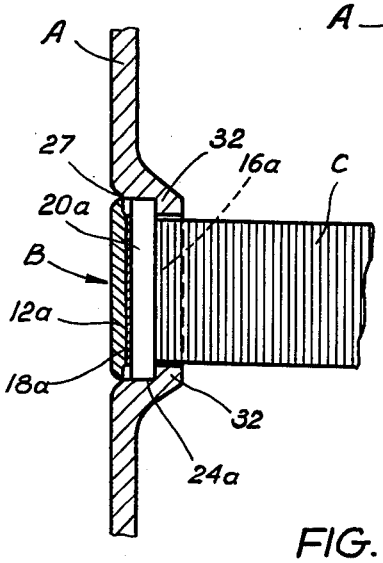
FIG. 4 is a longitudinal section.

Considering the variant illustrated in FIGS. 3 and 4 in which equal or corresponding parts are identified with the same reference symbols, opening 24*a* of the helmet is provided, toward its internal part with a peripheral enlargement 32, the walls of which are substantially shaped as the side walls of block 10*a*; specifically, the longitudinal ends of the peripheral enlargement 32 are shaped so as to be coupled to the blocking enlargement 22 of block B.

Figure 5:
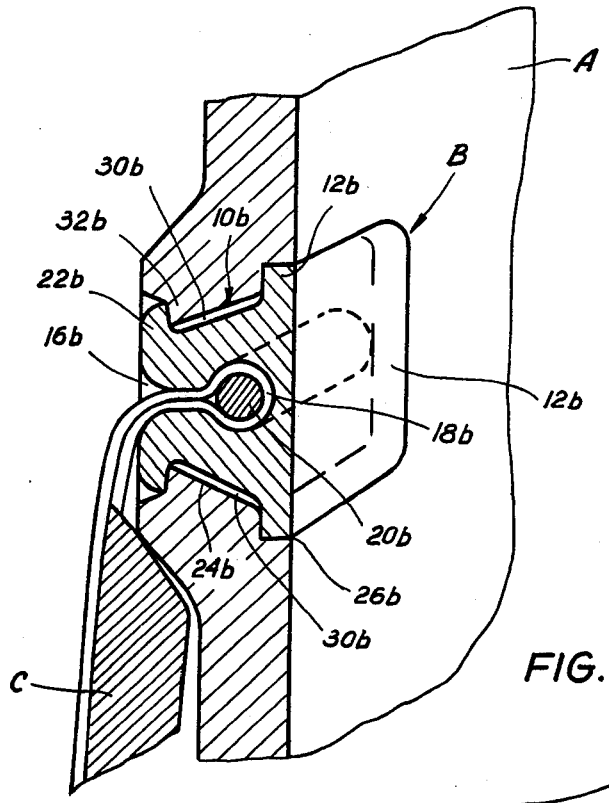
FIGS. 5 and 6 are perspective sectional views of furhter variants of embodiment of the device.

In this variant, pin 20*a* is of greater length with respect to the width of belt C and the projecting ends of said pin fit in notch 27 in the opposite side walls of opening 24*a* of the helmet: a further blocking element for belt C to the helmet is thus formed, to afford furhter safety. FIG. 5 is yet a further variant of the invention in which block 10*b* is provided with a flange 12*b* the contour of which is equal to that of said block to be level with the outer surface of helmet A. Also in this case belt C is retained directly by the block 10*b* by a loop 18*b* in the eyelet of which is inserted a pin 20*b* which may be of length equal to or greater than the width of belt C, as already considered.

In this variant, ribs 22*b* and grooves 32*b* are more pronounced, to ensure securing by snap action of device B to helmet A.

Figure 6:
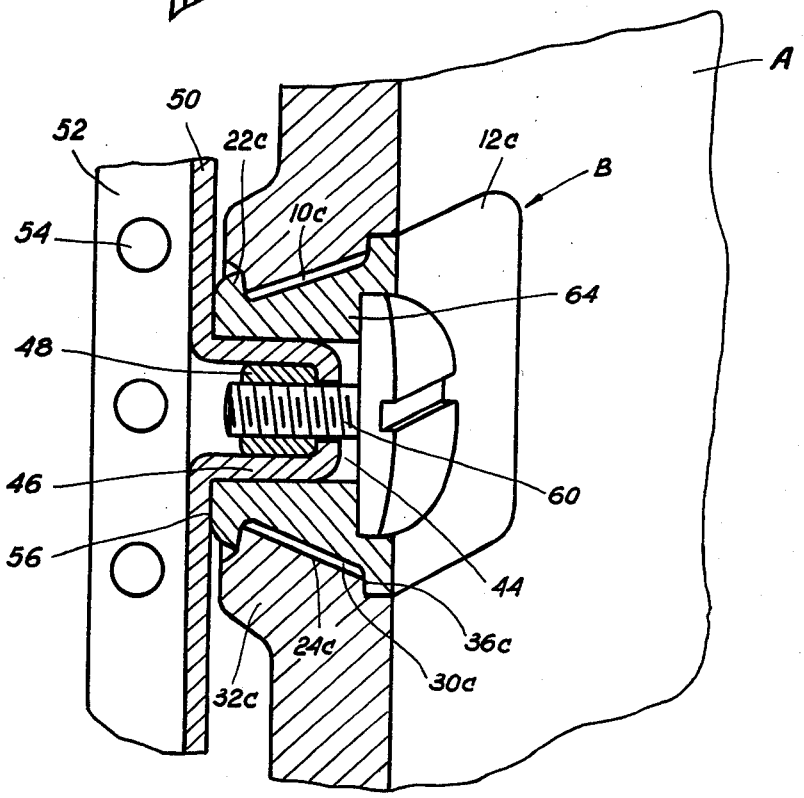

FIG. 6 shows another variant of device B which may be inserted in groove 24*e* in helmet A, and altogether similar to opening 24*b* in FIG. 5.

In this variant block 10*c* is provided with a through hole 44, preferably polyzonal, into which fits a projecting part 46 of equal shape, in a plate 50; belt C is secured in said plate in the known manner, for example, the plate may be provided with a slot to retain the belt or it may constitute the base plate for an anchoring means for adjustable retention of belt C. In the case illustrated, plate 50 is provided with perforated tabs 52 apt to retain a set of 3 pins on which belt C is wound.

Plate 50 is secured to helmet A by engagement against base 56 of block 10*c* by means of a screw 60 the head of which fits in groove 64 in flange 12*c*.

Screw 60 directly engages polygonal projecting part 46 or by nut 48.

It should be noted that with the type of connection contemplated in FIG. 6, plate 50 engages base 56 of block 10*c* thereby to distribute the compression stresses which would otherwise be exerted between the internal and outer faces of helmet A.

In practice the details of embodiment and end uses of the device may in any case vary without departing from the scope and domain of the patent invention.

I claim:

1. Device for securing belts and similar items to a wall of a structure, comprising a block made of resilient material, said block having a first end, a second end and a body, said body of the block having a bore going there through, said body of the block having slot means crossing said body from said bore to said second end;

a removable member inserted within said bore of the block;

belt means passing first time through said slot means bending around said removable member located within the bore and passing second time said slot means, so that two ends of said belt protrudes from said second end of the block;

said wall of the structure having at least one opening adapted to accommodate an outside surface of said block;

whereby in an assembled condition of said device said first end and outside surface of the block engage with said wall and said opening of the structure for tight securing of the belt inside of said bore and said slot means of the block.

2. Device according to claim 1, characterized in that resilient block (10) is provided, at one of its ends with a peripheral flange (12) which delimits a part of the engagement surfaces of the opposite grooves and which fits at least in part into a relative groove 26 in one of the faces of resin structure (A).

3. Device according to claim 1, characterized in that resilient block 40 is provided in opposite succession, with grooves and projecting parts engaging forcibly and resiliently, partially or totally in respective seats in the walls of the aperture in the resin structure.

4. Device according to claim 1, characterized in that the grooves and/or projecting parts in the resilient block are combined with substantially perpendicular grooves (30) which form flexible ribs engaging with the shaped walls of the aperture in the resin structure.

5. Device according to claim 1 characterized by a slotted seat (16–18) in resilient block (10) in a position opposite to flange (12) of said block and parallel to the grooves and/or projecting parts to house the looped end of the belt associated with a pin (20).

6. Device according to claim 1 characterized in that the ends of pin (20), the length of which is substantially equal to the length of belt C, co-operate with walls opposite adjacent to walls (28), with the grooves and/or projecting parts of the aperture for resilient block (10).

7. Device according to claim 1, characterized in that the ends of pin (20*a*) projecting from the edges of belt (C) fit in notches (27*a*) in the mid part of the walls opposite and adjacent to walls (28), with the grooves and/or projecting parts of the aperture for the resilient block.

8. Device according to claim 1 characterized by at least one through hole in resilient block (10*c*), substantially perpendicular to the grooves and/or projecting parts of said block to retain the securing means (50–60) for the belt or similar part.

9. Device according to claim 8 characterized by a plate (50) apt to retain the belt and securable by screws (60) to resilient blocks (10*c*) to secure said plate to resin structure (A).

10. Device according to claim 8 characterized in that plate (50) is perforated to engage a lock screw and in that it engages the opposite end of flange (12*c*) of resilient block (10*c*) to secure said plate to resin structure (A) by means of said resilient block.

11. Device according to claim 10 characterized by a polygonal hollow projecting part (46) in plate (50) to retain lock screw (60) and which is housed in a respective through hole in the resilient block to secure the plate to resin structure A.

12. Device according to claim 10, characterized in that the head of lock screw (60) fits in a groove in flange (12*c*) of the resilient block so that both said head and the flanged face will be substantially co-planar and not projecting from the surface of the resin structure.

* * * * *